US010354771B2

(12) United States Patent
Eriksson et al.

(10) Patent No.: US 10,354,771 B2
(45) Date of Patent: Jul. 16, 2019

(54) ISOTOPE PRODUCTION SYSTEM HAVING A TARGET ASSEMBLY WITH A GRAPHENE TARGET SHEET

(71) Applicant: General Electric Company, Schenectady, NY (US)

(72) Inventors: Tomas Eriksson, Uppsala (SE); Martin Pärnaste, Uppsala (SE); Jonas Norling, Uppsala (SE)

(73) Assignee: General Electric Company, Schenectady, NY (US)

( * ) Notice: Subject to any disclaimer, the term of this patent is extended or adjusted under 35 U.S.C. 154(b) by 128 days.

(21) Appl. No.: 15/348,198

(22) Filed: Nov. 10, 2016

(65) Prior Publication Data

US 2018/0130567 A1 May 10, 2018

(51) Int. Cl.

| | |
|---|---|
| ***G21G 1/10*** | (2006.01) |
| ***G21G 1/00*** | (2006.01) |
| ***H05H 6/00*** | (2006.01) |

(52) U.S. Cl.

CPC ..... *G21G 1/10* (2013.01); *G21G 1/001* (2013.01); *H05H 6/00* (2013.01); *G21G 2001/0015* (2013.01); *G21G 2001/0021* (2013.01)

(58) Field of Classification Search

CPC ..... G21G 1/10; G21G 1/04; G21G 1/001; H05H 6/00

USPC ..... 376/190, 194

See application file for complete search history.

(56) References Cited

U.S. PATENT DOCUMENTS

| | | | | |
|---|---|---|---|---|
| 6,433,495 | B1 | 8/2002 | Wiberg | |
| 7,223,463 | B2 * | 5/2007 | Arakida | G21K 1/14 250/251 |
| 8,288,736 | B2 | 10/2012 | Amelia et al. | |
| 2005/0201504 | A1 | 9/2005 | Zeisler et al. | |

(Continued)

FOREIGN PATENT DOCUMENTS

| | | | |
|---|---|---|---|
| EP | 2146555 | A1 | 1/2010 |
| WO | 97/07122 | A2 | 2/1997 |

(Continued)

OTHER PUBLICATIONS

Korenev, "The Use of Graphene as Stripper Foils in Siemens Eclipse Cyclotrons", Proceedings of Cyclotrons 2016—Pre-Release Snapshot, Oct. 18, 2016, pp. 1-3. (Year: 2016).*

(Continued)

*Primary Examiner* — Jack W Keith
*Assistant Examiner* — Daniel Wasil
(74) *Attorney, Agent, or Firm* — Dean D. Small; The Small Patent Law Group, LLC

(57) ABSTRACT

Target assembly for an isotope production system. The target assembly includes a target body having a production chamber and a beam cavity that is adjacent to the production chamber. The production chamber is configured to hold a target material. The beam cavity opens to an exterior of the target body and is configured to receive a particle beam that is incident on the production chamber. The target assembly also includes a target sheet positioned to separate the beam cavity and the production chamber. The target sheet has a side that is exposed to the production chamber such that the target sheet is in contact with the target material during isotope production. The target sheet includes graphene.

7 Claims, 8 Drawing Sheets

(56) References Cited

U.S. PATENT DOCUMENTS

| | | | | |
|---|---|---|---|---|
| 2006/0291607 | A1* | 12/2006 | Hong | H05H 6/00 376/168 |
| 2009/0090875 | A1 | 4/2009 | Gelbart et al. | |
| 2011/0255646 | A1 | 10/2011 | Eriksson et al. | |
| 2013/0064338 | A1* | 3/2013 | Matsumoto | H05H 6/00 376/108 |
| 2013/0163708 | A1 | 6/2013 | Lambert et al. | |
| 2013/0259180 | A1 | 10/2013 | Norling et al. | |
| 2017/0004897 | A1* | 1/2017 | Eriksson | G21G 1/10 |

FOREIGN PATENT DOCUMENTS

| | | | |
|---|---|---|---|
| WO | 2003099374 | A2 | 12/2003 |
| WO | 2015/175972 | A2 | 11/2015 |
| WO | 2016005492 | A1 | 1/2016 |

OTHER PUBLICATIONS

Liu, "Defecting controllability of bombarding graphene with different energetic atoms via reactive force field model", J. Appl. Phys. 114, 054313 (2013). (Year: 2013).*

International Search Report and Written Opinion for corresponding PCT application No. PCT/US2017/060183 dated Jan. 8, 2018; 14 pages.

J. Vincent et al.: "The Ionetix Ion-12SC Compact Superconductiong Cyclotronfor Production of Medical Isotopes", 21st International Conference on Cyclotrons and their Applications, Zurich, Switzerland, Sep. 11-16, 2016; pp. 290-293.

H. Wang et al.: "Design of High-Power Graphene Beam Window", 5th International Particle Acclerator Conference, Dresden, Germany, Jun. 15-20, 2014; pp. 45-47.

Marti et al.; Stripper Foil Developments at NSCL/MSU; Proceedings of Cyclotrons; 2010; 3 pages.

International Atomic Energy Agency; Cyclotron Produced Radionuclides: Operation and Maintenance of Gas and Liquid Targets; IAEA Radioisotopes and Radiopharmaceuticals Series No. 4; 2012; 120 pages.

Bender et al.; Supported Foil Solution for Legacy Helium-Cooled Targets When an Alternative to Havar Foil Material is Desired; PET Imaging Center, University of Iowa Health Care; 2010; 2 pages.

Stevenson; Universal Methods of Irradiating Target Materials for High Current Accelerator Radioisotope Production; TRIUMF; 1997; 4 pages.

* cited by examiner

ISOTOPE PRODUCTION SYSTEM HAVING A TARGET ASSEMBLY WITH A GRAPHENE TARGET SHEET

BACKGROUND

The subject matter disclosed herein relates generally to isotope production systems, and more particularly to isotope production systems having a target material that is irradiated with a particle beam.

Radioisotopes (also called radionuclides) have several applications in medical therapy, imaging, and research, as well as other applications that are not medically related. Systems that produce radioisotopes typically include a particle accelerator, such as a cyclotron, that accelerates a beam of charged particles (e.g., H− ions) and directs the beam into a target material to generate the isotopes. The cyclotron is a complex system that uses electrical and magnetic fields to accelerate and guide the charged particles along a predetermined orbit within an acceleration chamber. When the particles reach an outer portion of the orbit, the charged particles form a particle beam that is directed toward a target assembly that holds the target material for isotope production.

The target material, which is typically a liquid, gas, or solid, is contained within a chamber of the target assembly. The target assembly forms a beam passage that receives the particle beam and permits the particle beam to be incident on the target material in the chamber. To contain the target material within the chamber, the beam passage is separated from the chamber by one or more foils. For example, the chamber may be defined by a void within a target body. A target foil covers the void on one side and a section of the target assembly may cover the opposite side of the void to define the chamber therebetween. The particle beam passes through the target foil and deposits a relatively large amount of power within a relatively small volume of the target material, thereby causing a large amount of thermal energy to be generated within the chamber. A portion of this thermal energy is transferred to the target foil.

Target foils experience elevated temperatures and pressures along the side of the target foil that borders the production chamber. The elevated temperatures and pressures cause stress that renders the target foil vulnerable to rupture, melting, or other damage. If the foils are damaged, the level of energy that enters the production chamber increases. Greater energy levels may generate unwanted isotopes or other impurities that render the target material unusable.

In addition, the target foils absorb energy from the particle beam. This energy might otherwise be useful for reactions within the production chamber. In addition, the target foils become highly activated over time and pose a health problem to technicians that must replace the target foils. The target foils may also contaminate the target media when the activated ions from the target foil are absorbed by the target material. Moreover, isotope production for at least some reactions may be better when the temperatures of the target material are less elevated.

To address the challenges of overheated foils, conventional systems include a cooling system that transfers the thermal energy away from the target foil. The cooling system directs a cooling medium (e.g., helium) through the cooling chamber that absorbs thermal energy from the foils. Despite the cooling system, however, the temperatures of the target foil and target material may still become excessive and other challenges, such as those described above, remain.

BRIEF DESCRIPTION

In an embodiment, a target assembly for an isotope production system is provided. The target assembly includes a target body having a production chamber and a beam cavity that is adjacent to the production chamber. The production chamber is configured to hold a target material. The beam cavity opens to an exterior of the target body and is configured to receive a particle beam that is incident on the production chamber. The target assembly also includes a target sheet positioned to separate the beam cavity and the production chamber. The target sheet has a side that is exposed to the production chamber such that the target sheet is in contact with the target material during isotope production. The target sheet includes graphene.

In some aspects, the target sheet includes a graphene layer that consists essentially of the graphene.

In some aspects, the target sheet also includes a chamber layer that is stacked with respect to the graphene layer. The chamber layer is positioned between the graphene layer and the production chamber and is exposed to the production chamber such that the target material is in contact with the chamber layer during isotope production. Optionally, the chamber layer is devoid of a material that causes long-lived isotopes when activated by the particle beam. Optionally, the chamber layer comprises gold, niobium, tantalum, titanium, or alloy including one or more of the above.

In some aspects, the target sheet has a thickness that is at least 20 micrometers.

In some aspects, the target sheet comprises a graphene layer that consists essentially of the graphene, the graphene layer having a thickness that is at least 20 micrometer.

In some aspects, the target body includes a grid section disposed in the beam passage. The grid section has a back side that interfaces with a front side of the target sheet. The grid section supports the target sheet to reduce the likelihood of rupture from elevated pressure in the production chamber.

In an embodiment, an isotope production system is provided that includes a particle accelerator configured to generate a particle beam. The isotope a target assembly including a target body having a production chamber and a beam cavity that is adjacent to the production chamber, the production chamber configured to hold a target liquid, the beam cavity opening to an exterior of the target body and being configured to receive a particle beam that is incident on the production chamber, the target assembly also including a target sheet positioned to separate the beam cavity and the production chamber, the target sheet having a side that is exposed to the production chamber such that the target material is in contact with the target sheet during isotope production, wherein the target sheet comprises graphene.

In some aspects, the target sheet includes a graphene layer that consists essentially of graphene.

In some aspects, the target sheet also includes a chamber layer that is stacked with respect to the graphene layer. The chamber layer is positioned between the graphene layer and the production chamber and exposed to the production chamber such that the target material is in contact with the chamber layer during isotope production. Optionally, the chamber layer is devoid of a material that causes long-lived isotopes when activated by the particle beam. Optionally, the target sheet has a thickness that is at least 20 micrometer.

In some aspects, the target body includes a grid section disposed in the beam passage, the grid section having a back side that interfaces with a front side of the target sheet, the grid section supporting the target sheet to reduce the likelihood of rupture from elevated pressure in the production chamber.

In some aspects, the isotope production system also includes a fluid-control system configured to flow $^{68}Zn$ nitrate in nitric acid into the production chamber.

In an embodiment, a method of generating radioisotopes is provided. The method includes providing a target material into a production chamber of a target assembly. The target assembly has a production chamber and a beam cavity that is adjacent to the production chamber. The production chamber is configured to hold a target liquid. The beam cavity is configured to receive a particle beam that is incident on the production chamber. The target assembly also includes a target sheet positioned to separate the beam cavity and the production chamber. The target sheet has a side that is exposed to the production chamber such that the target material is in contact with the target sheet during isotope production. The target sheet includes graphene. The method also includes directing the particle beam onto the target material. The particle beam passes through the target sheet to be incident on the target material.

In some aspects, the target material includes $^{68}Zn$ nitrate in nitric acid. The graphene layer is exposed to the target material such that the target material is in contact with the graphene layer during isotope production. Optionally, an energy of the particle beam that is incident upon the target material is between 7 and 24 MeV.

In some aspects, the target material includes natural $^{14}N_2$ gas. Optionally, the target sheet includes a chamber layer that is disposed between the production chamber and the graphene layer. The chamber layer impedes the flow of non-active carbon from the graphene layer to the production chamber.

DETAILED DESCRIPTION

Figure 1:
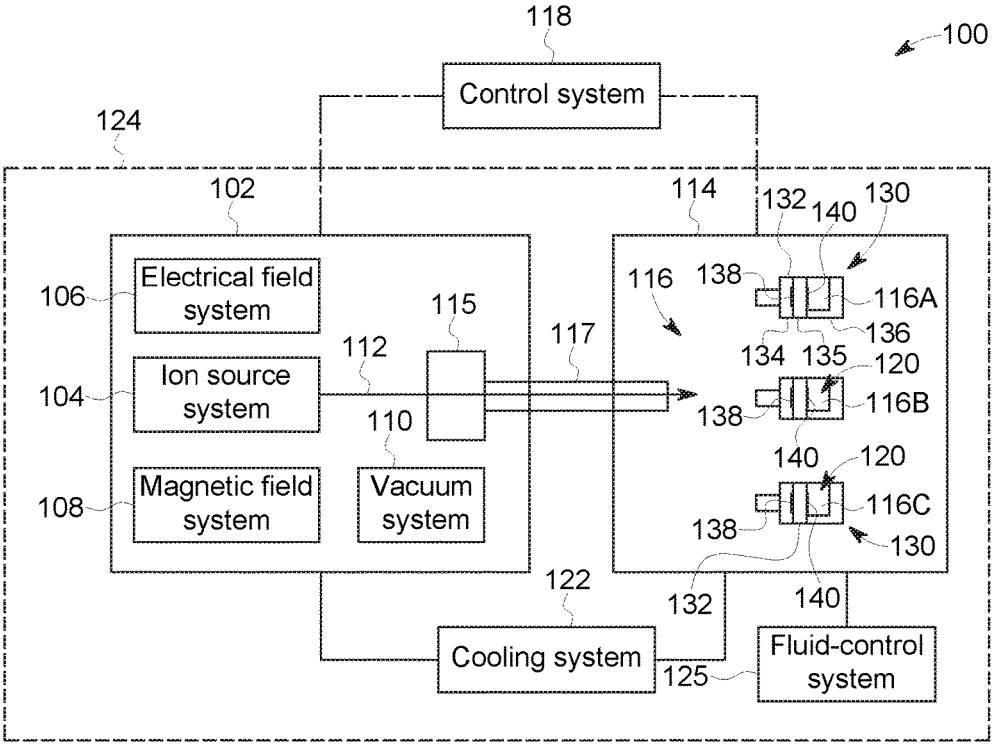
FIG. 1 is a block diagram of an isotope production system in accordance with an embodiment.

The foregoing summary, as well as the following detailed description of certain embodiments will be better understood when read in conjunction with the appended drawings. To the extent that the figures illustrate diagrams of the blocks of various embodiments, the blocks are not necessarily indicative of the division between hardware. Thus, for example, one or more of the blocks may be implemented in a single piece of hardware or multiple pieces of hardware. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

FIG. 1 is a block diagram of an isotope production system 100 formed in accordance with an embodiment. The isotope production system 100 includes a particle accelerator 102 (e.g., cyclotron) having several sub-systems including an ion source system 104, an electrical field system 106, a magnetic field system 108, a vacuum system 110, a cooling system 122, and a fluid-control system 125. During use of the isotope production system 100, a target material 116 (e.g., target liquid or target gas) is provided to a designated production chamber 120 of the target system 114. The target material 116 may be provided to the production chamber 120 through the fluid-control system 125. The fluid-control system 125 may control flow of the target material 116 through one or more pumps and valves (not shown) to the production chamber 120. The fluid-control system 125 may also control a pressure that is experienced within the production chamber 120 by providing an inert gas into the production chamber 120.

During operation of the particle accelerator 102, charged particles are placed within or injected into the particle accelerator 102 through the ion source system 104. The magnetic field system 108 and electrical field system 106 generate respective fields that cooperate with one another in producing a particle beam 112 of the charged particles.

Also shown in FIG. 1, the isotope production system 100 has an extraction system 115. The target system 114 may be positioned adjacent to the particle accelerator 102. To generate isotopes, the particle beam 112 is directed by the particle accelerator 102 through the extraction system 115 along a beam path 117 and into the target system 114 so that the particle beam 112 is incident upon the target material 116 located at the designated production chamber 120. It should be noted that in some embodiments the particle accelerator 102 and the target system 114 are not separated by a space or gap (e.g., separated by a distance) and/or are not separate parts. Accordingly, in these embodiments, the particle accelerator 102 and target system 114 may form a single component or part such that the beam path 117 between components or parts is not provided.

The isotope production system 100 is configured to produce radioisotopes (also called radionuclides) that may be used in medical imaging, research, and therapy, but also for other applications that are not medically related, such as scientific research or analysis. When used for medical purposes, such as in Nuclear Medicine (NM) imaging or Positron Emission Tomography (PET) imaging, the radioisotopes may also be called tracers. The isotope production system 100 may produce the isotopes in predetermined amounts or batches, such as individual doses for use in medical imaging or therapy. By way of example, the isotope production system 100 may generate $^{68}Ga$ isotopes from a target liquid comprising $^{68}Zn$ nitrate in nitric acid. The isotope production system 100 may also be configured to generate protons to make $^{18}F^-$ isotopes in liquid form. The target material used to make these isotopes may be enriched $^{18}O$ water or $^{16}O$-water. In some embodiments, the isotope production system 100 may also generate protons or deuterons in order to produce $^{15}O$ labeled water. Isotopes having different levels of activity may be provided.

In some embodiments, the isotope production system 100 uses $^{1}H^-$ technology and brings the charged particles to a low energy (e.g., about 8 MeV or about 14 MeV) with a beam current of approximately 10-30 μA. In such embodiments, the negative hydrogen ions are accelerated and guided through the particle accelerator 102 and into the extraction system 115. The negative hydrogen ions may then hit a stripper foil (not shown in FIG. 1) of the extraction system 115 thereby removing the pair of electrons and making the particle a positive ion, $^{1}H^+$. However, in alternative embodiments, the charged particles may be positive ions, such as $^{1}H^+$, $^{2}H^+$, and $^{3}He^+$. In such alternative embodiments, the extraction system 115 may include an electrostatic deflector that creates an electric field that guides the particle beam toward the target material 116. It should be noted that the various embodiments are not limited to use in lower energy systems, but may be used in higher energy systems, for example, up to 25 MeV and higher beam currents.

The isotope production system 100 may include a cooling system 122 that transports a cooling fluid (e.g., water or gas, such as helium) to various components of the different systems in order to absorb heat generated by the respective components. For example, one or more cooling channels may extend proximate to the production chambers 120 and absorb thermal energy therefrom. The isotope production system 100 may also include a control system 118 that may be used to control the operation of the various systems and components. The control system 118 may include the necessary circuitry for automatically controlling the isotope production system 100 and/or allowing manual control of certain functions. For example, the control system 118 may include one or more processors or other logic-based circuitry. The control system 118 may include one or more user-interfaces that are located proximate to or remotely from the particle accelerator 102 and the target system 114. Although not shown in FIG. 1, the isotope production system 100 may also include one or more radiation and/or magnetic shields for the particle accelerator 102 and the target system 114.

The isotope production system 100 may be configured to accelerate the charged particles to a predetermined energy level. For example, some embodiments described herein accelerate the charged particles to an energy of approximately 18 MeV or less. In other embodiments, the isotope production system 100 accelerates the charged particles to an energy of approximately 16.5 MeV or less. In particular embodiments, the isotope production system 100 accelerates the charged particles to an energy of approximately 9.6 MeV or less. In more particular embodiments, the isotope production system 100 accelerates the charged particles to an energy of approximately 7.8 MeV or less. However, embodiments describe herein may also have an energy above 18 MeV. For example, embodiments may have an energy above 100 MeV, 500 MeV or more. Likewise, embodiments may utilize various beam current values. By way of example, the beam current may be between about of approximately 10-30 μA. In other embodiments, the beam current may be above 30 μA, above 50 μA, or above 70 μA. Yet in other embodiments, the beam current may be above 100 μA, above 150 μA, or above 200 μA.

The isotope production system 100 may have multiple production chambers 120 where separate target materials 116A-C are located. A shifting device or system (not shown) may be used to shift the production chambers 120 with respect to the particle beam 112 so that the particle beam 112 is incident upon a different target material 116. Alternatively, the particle accelerator 102 and the extraction system 115 may not direct the particle beam 112 along only one path, but may direct the particle beam 112 along a unique path for each different production chamber 120A-C. Furthermore, the beam path 117 may be substantially linear from the particle accelerator 102 to the production chamber 120 or, alternatively, the beam path 117 may curve or turn at one or more points therealong. For example, magnets positioned alongside the beam path 117 may be configured to redirect the particle beam 112 along a different path.

The target system 114 includes a plurality of target assemblies 130, although the target system 114 may include only one target assembly 130 in other embodiments. The target assembly 130 includes a target body 132 having a plurality of body sections 134, 135, 136. The target assembly 130 is also configured to one or more foils through which the particle beam passes before colliding with the target material. For example, the target assembly 130 includes a first sheet 138 and a second sheet 140. As described in greater detail below, the first sheet 138 and the second sheet 140 may each engage a grid section (not shown in FIG. 1) of the target assembly 130. The second sheet 140 may also be referred to as a target sheet.

Particular embodiments may be devoid of a direct cooling system for the first and second sheets. Conventional target systems direct a cooling medium (e.g., helium) through a space that exists between the first and second sheets. The cooling medium contacts the first and second sheets and absorbs the thermal energy directly from the first and second sheets and transfers the thermal energy away from the first and second sheets. Embodiments set forth herein may be devoid of such a cooling system. For example, a radial surface that surrounds this space may be devoid of ports that are fluidically coupled to channels. It should be understood, however, that the cooling system 122 may cool other objects of the target system 114. For instance, the cooling system 122 may direct cooling water through the body section 136 to absorb thermal energy from the production chamber 120. However, it should be understood that embodiments may include ports along the radial surface. Such ports may be used to provide a cooling medium for cooling the first and second sheets 138, 140 or for evacuating the space between the first and second sheets 138, 140.

Examples of isotope production systems and/or cyclotrons having one or more of the sub-systems described herein may be found in U.S. Patent Application Publication No. 2011/0255646, which is incorporated herein by reference in its entirety. Furthermore, isotope production systems and/or cyclotrons that may be used with embodiments described herein are also described in U.S. patent application Ser. Nos. 12/492,200; 12/435,903; 12/435,949; 12/435,931 and U.S. patent application Ser. No. 14/754,878, each of which is incorporated herein by reference in its entirety.

Figure 2:
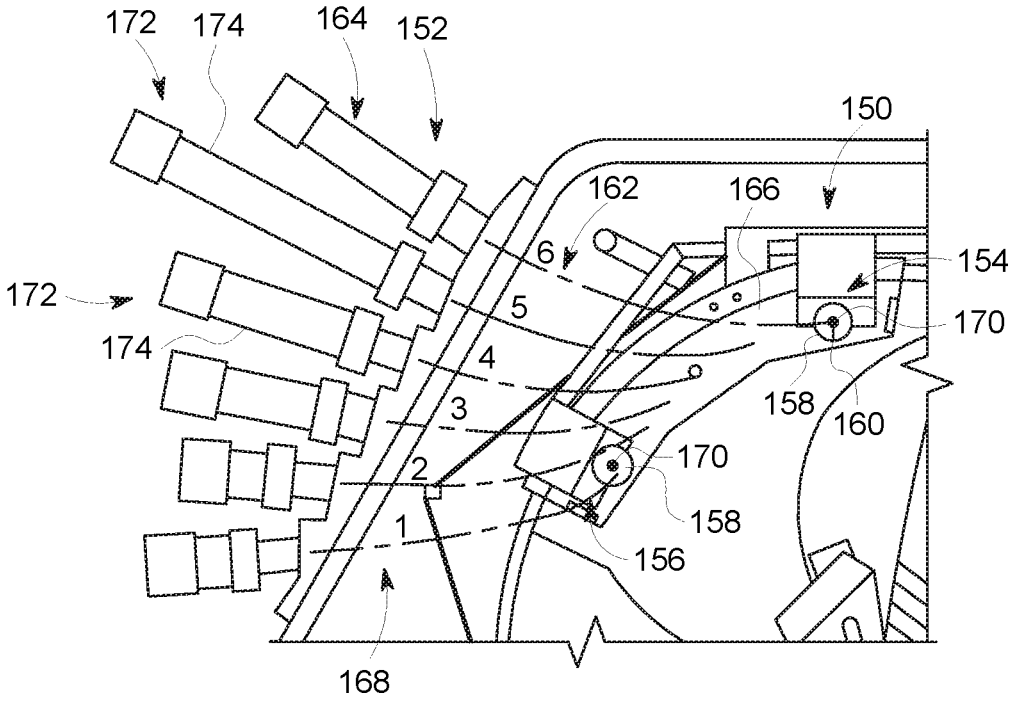
FIG. 2 is a side view of an extraction system and a target system in accordance with an embodiment.

FIG. 2 is a side view of the extraction system 150 and the target system 152. In the illustrated embodiment, the extraction system 150 includes first and second extraction units 156, 158 that each includes a foil holder 158 and one or more extraction foils 160 (also referred to as stripper foils). The extraction process may be based on a stripping-foil principle. More specifically, the electrons of the charged particles (e.g., the accelerated negative ions) are stripped as the charged particles pass through the extraction foil 160. The charge of the particles is changed from a negative charge to a positive charge thereby changing the trajectory of the particles in the magnet field. The extraction foils 160 may be positioned to control a trajectory of an external particle beam 162 that includes the positively-charged particles and may be used to steer the external particle beam 162 toward designated target locations 164.

In the illustrated embodiment, the foil holders 158 are rotatable carousels that are capable of holding one or more extraction foils 160. However, the foil holders 158 are not required to be rotatable. The foil holders 158 may be selectively positioned along a track or rail 166. The extraction system 150 may have one or more extraction modes. For example, the extraction system 150 may be configured for single-beam extraction in which only one external particle beam 162 is guided to an exit port 168. In FIG. 2, there are six exit ports 168, which are enumerated as 1-6.

The extraction system 150 may also be configured for dual-beam extraction in which two external beams 162 are guided simultaneously to two exit ports 168. In a dual-beam mode, the extraction system 150 may selectively position the extraction units 156, 158 such that each extraction unit intercepts a portion of the particle beam (e.g., top half and bottom half). The extraction units 156, 158 are configured to move along the track 166 between different positions. For example, a drive motor may be used to selectively position the extraction units 156, 158 along the track 166. Each extraction unit 156, 158 has an operating range that covers one or more of the exit ports 168. For example, the extraction unit 156 may be assigned to the exit ports 4, 5, and 6, and the extraction unit 158 may be assigned to the exit ports 1, 2, and 3. Each extraction unit may be used to direct the particle beam into the assigned exit ports.

The foil holders 158 may be insulated to allow for current measurement of the stripped-off electrons. The extraction foils 160 are located at a radius of the beam path where the beam has reached a final energy. In the illustrated embodiment, each of the foil holders 158 holds a plurality of extraction foils 160 (e.g., six foils) and is rotatable about an axis 170 to enable positioning different extraction foils 160 within the beam path.

The target system 152 includes a plurality of target assemblies 172. A total of six target assemblies 172 are shown and each corresponds to a respective exit port 168. When the particle beam 162 has passed the selected extraction foil 160, it will pass into the corresponding target assembly 172 through the respective exit port 168. The particle beam enters a target chamber (not shown) of a corresponding target body 174. The target chamber holds the target material (e.g., liquid, gas, or solid material) and the particle beam is incident upon the target material within the target chamber. The particle beam may first be incident upon one or more target sheets within the target body 174, as described in greater detail below. The target assemblies 172 are electrically insulated to enable detecting a current of the particle beam when incident on the target material, the target body 174, and/or the target sheets or other foils within the target body 174.

Examples of isotope production systems and/or cyclotrons having one or more of the sub-systems described herein may be found in U.S. Patent Application Publication No. 2011/0255646, which is incorporated herein by reference in its entirety. Furthermore, isotope production systems and/or cyclotrons that may be used with embodiments described herein are also described in U.S. patent application Ser. Nos. 12/492,200; 12/435,903; 12/435,949; 12/435,931 and U.S. patent application Ser. No. 14/754,878, each of which is incorporated herein by reference in its entirety.

Figure 3:
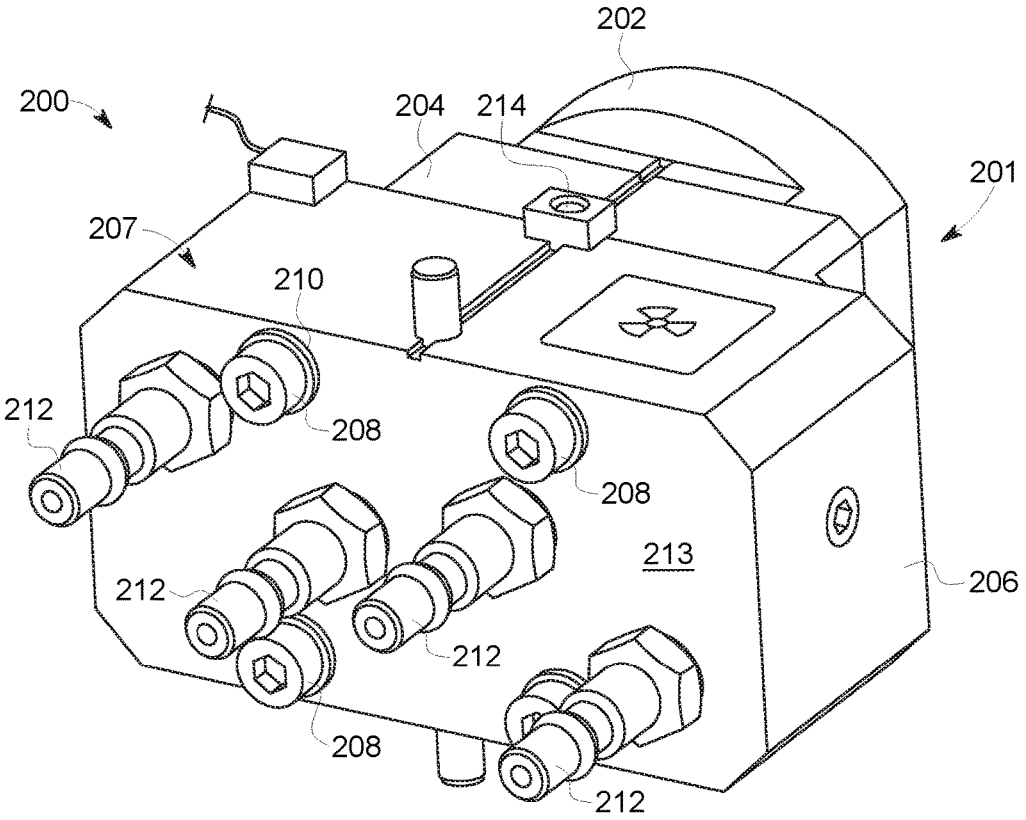
FIG. 3 is a rear perspective view of a target assembly in accordance with an embodiment.
Figure 4:
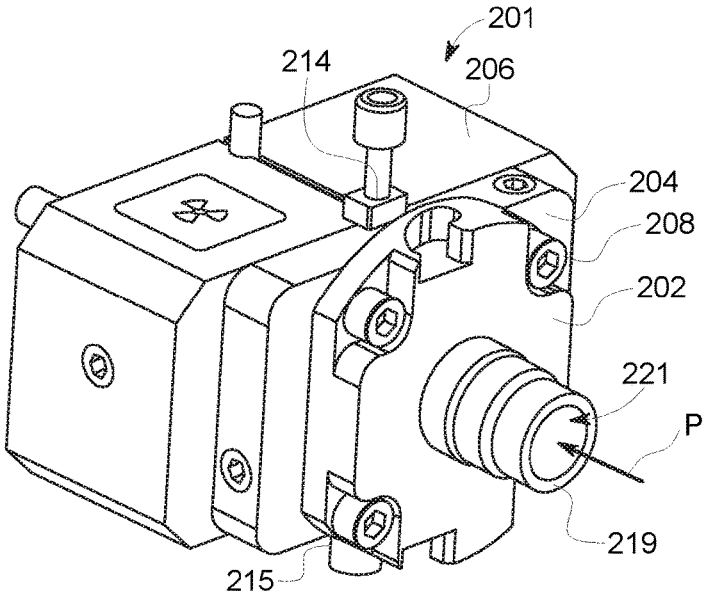
FIG. 4 is front perspective view of the target assembly of FIG. 3.

FIGS. 3 and 4 are rear and front perspective views, respectively, of a target assembly 200 formed in accordance with an embodiment. FIG. 4 is an exploded view of the target assembly 200. The target assembly 200 is configured for use in an isotope production system, such as the isotope production system 100 (FIG. 1). For example, the target assembly 200 may be similar or identical to the target assembly 130 (FIG. 1) of the isotope production system 100 or the target assembly 172 (FIG. 2). The target assembly 200 includes a target body 201, which is fully assembled in FIGS. 3 and 4.

Figure 5:
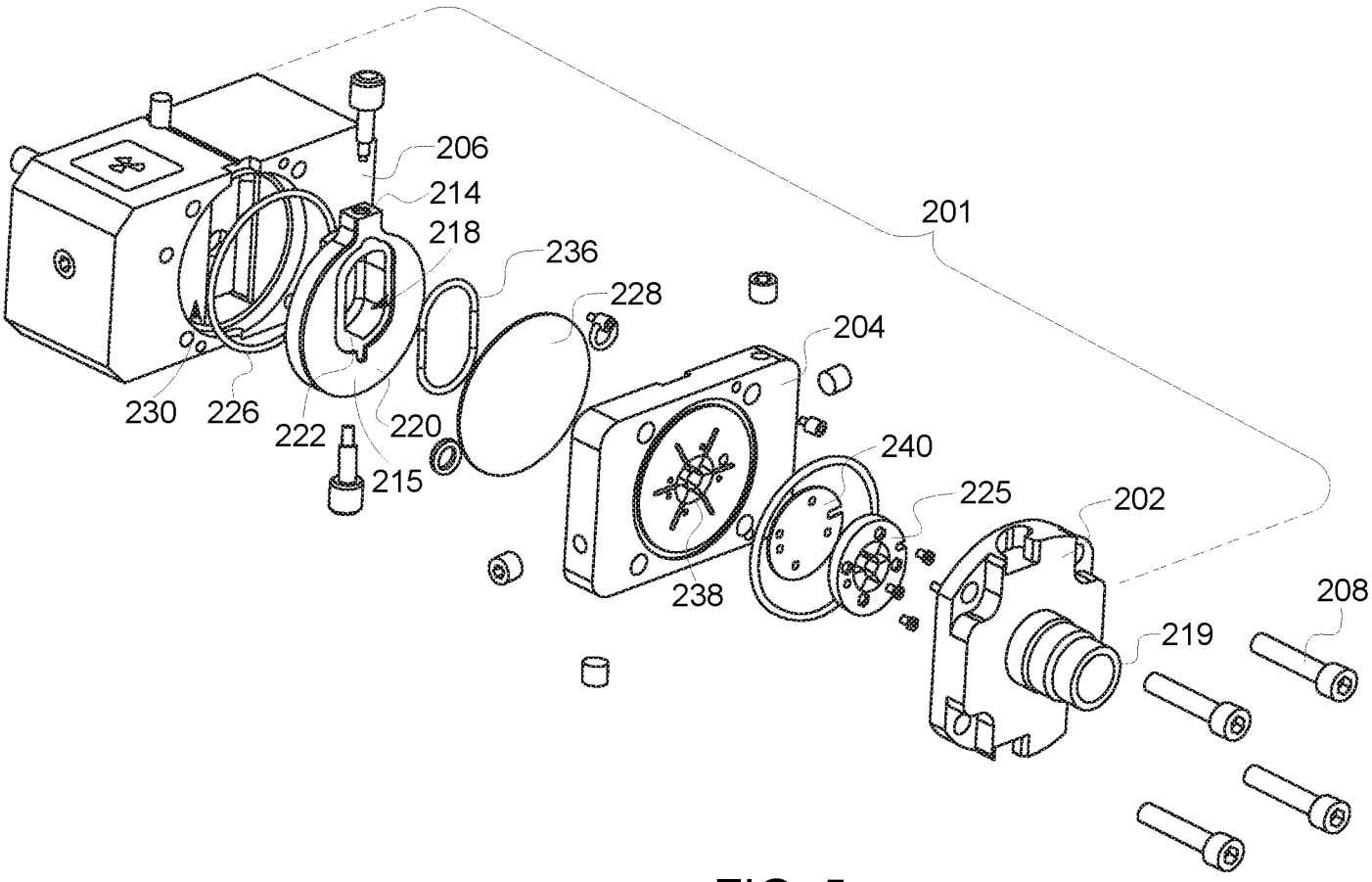
FIG. 5 is an exploded view of the target assembly of FIG. 3.

The target body 201 is formed from three body sections 202, 204, 206, a target insert 220 (FIG. 5), and a grid section 225 (FIG. 5). The body sections 202, 204, 206 define an outer structure or exterior of the target body 201. In particular, the outer structure of the target body 201 is formed from the body section 202 (which may be referred to as a front body section or flange), the body section 204 (which may be referred to as an intermediate body section) and the body section 206 (which may be referred to as a rear body section). The body sections 202, 204 and 206 include blocks of rigid material having channels and recesses to form various features. The channels and recesses may hold one or more components of the target assembly 200.

The target insert 220 and the grid section 225 (FIG. 5) also include blocks of rigid material having channels and recesses to form various features. The body sections 202, 204, 206, the target insert 220, and the grid section 225 may be secured to one another by suitable fasteners, illustrated as a plurality of bolts 208 (FIGS. 4 and 5) each having a corresponding washer (not shown). When secured to one another, the body sections 202, 204, 206, the target insert 220, and the grid section 225 form a sealed target body 201. The sealed target body 201 is sufficiently constructed to prevent or severely limit leakage of fluids or gas form the target body 201.

As shown in FIG. 3, the target assembly 200 includes a plurality of fittings 212 that are positioned along a rear surface 213. The fittings 212 may operate as ports that provide fluidic access into the target body 201. The fittings 212 are configured to be operatively coupled to a fluid-control system, such as the fluid-control system 125 (FIG. 1). The fittings 212 may provide fluidic access for helium and/or cooling water. In addition to the ports formed by the fittings 212, the target assembly 200 may include a first material port 214 and a second material port 215 (shown in FIG. 6). The first and second material ports 214, 215 are in flow communication with a production chamber 218 (FIG. 5) of the target assembly 200. The first and second material ports 214, 215 are operatively coupled to the fluid-control system. In an exemplary embodiment, the second material port 215 may provide a target material to the production chamber 218, and the first material port 214 may provide a working gas (e.g., inert gas) for controlling the pressure experienced by the target liquid within the production chamber 218. In other embodiments, however, the first material port 214 may provide the target material and the second material port 215 may provide the working gas.

The target body 201 forms a beam passage 221 that permits a particle beam (e.g., proton beam) to be incident on the target material within the production chamber 218. The particle beam (indicated by arrow P in FIG. 4) may enter the target body 201 through a passage opening 219 (FIGS. 4 and 5). The particle beam travels through the target assembly 200 from the passage opening 219 to the production chamber 218 (FIG. 5). During operation, the production chamber 218 is filled with a target liquid or a target gas. For example, the target liquid may be about 2.5 milliliters (ml) of water comprising designated isotopes (e.g., $H_2{}^{18}O$). The production chamber 218 is defined within the target insert 220 that may comprise, for example, a Niobium material having a cavity 222 (FIG. 5) that opens on one side of the target insert 220. The target insert 220 includes the first and second material ports 214, 215. The first and second material ports 214, 215 are configured to receive, for example, fittings or nozzles.

With respect to FIG. 5, the target insert 220 is aligned between the body section 206 and the body section 204. The target assembly 200 may include a sealing ring 226 that is positioned between the body section 206 and the target insert 220. The target assembly 200 also includes a target sheet 228 and a sealing border 236 (e.g., a Helicoflex® border). The target sheet 228 is positioned between the body section 204 and the target insert 220 and covers the cavity 222 thereby enclosing the production chamber 218. The body section 206 also includes a cavity 230 (FIG. 5) that is sized and shaped to receive therein the sealing ring 226 and a portion of the target insert 220.

A front sheet 240 of the target assembly 200 may be positioned between the body section 204 and the body section 202. The front sheet 240 may be an alloy disc similar to the target sheet 228. The front sheet 240 aligns with a grid section 238 of the body section 204. The front sheet 240 and the target sheet 228 may have different functions in the target assembly 228. In some embodiments, the front sheet 240 may be referred to as a degrader sheet that reduces the energy of the particle beam P. For example, the front sheet 240 may reduce the energy of the particle beam by at least 10%. The energy of the particle beam that is incident upon the target material may be between 7 MeV and 24 MeV. In more particular embodiments, the energy of the particle beam that is incident upon the target material may be between 13 MeV and 15 MeV. The front sheet 240 and the target sheet 228 may be referred to, such as in the claims, the first sheet and the second sheet, respectively.

In some embodiments, the target sheet 228 comprises one or more graphene layers (e.g., polycrystalline graphene). In particular embodiments, the target sheet 228 is only a single graphene layer. The graphene layer (or layers) may be designed or selected to have predetermined qualities. By way of example, the graphene layers may have area densities that are between 0.1 and 2.0 mg/cm$^3$. The graphene layer density may be approximately between 1.5 and 2.0 g/cm$^3$. The graphene layer may have thickness that provides sufficient yield strength properties. In particular embodiments, a thickness of the target sheet 228 may be at least 20 micrometers or at least 25 micrometers. In more particular embodiments, the thickness of the target sheet 228 may be at least 30 micrometers or at least 35 micrometers or at least 40 micrometers. In particular embodiments, a thickness of the target sheet 228 may be at most 100 micrometers or at most 50 micrometers. It should be understood, however, that other dimensions (e.g., thicknesses) may be used by various embodiments. For example, greater thicknesses or smaller thicknesses other than those described herein may be used.

The graphene layer may have predetermined thermal conductivity properties. For example, in some embodiments, a measured thermal diffusivity may be at least 1308 mm$^2$/s. An in-plane thermal conductivity may be at least 1400 W/mK with a measured sheet resistance of between about 10 and 270 Ohm/sq. In this example, the graphene layer may have a bulk density of 1.55 g/cm$^3$ at a temperature of 25° C. and a specific heat Cp 0.73 J/gK. The in-plane thermal conductivity of the graphene foil sample was found to be 1480 W/mK. Measured sheet resistance of graphene films is in the range of 13-260 Ohm/sq.

Figure 7:
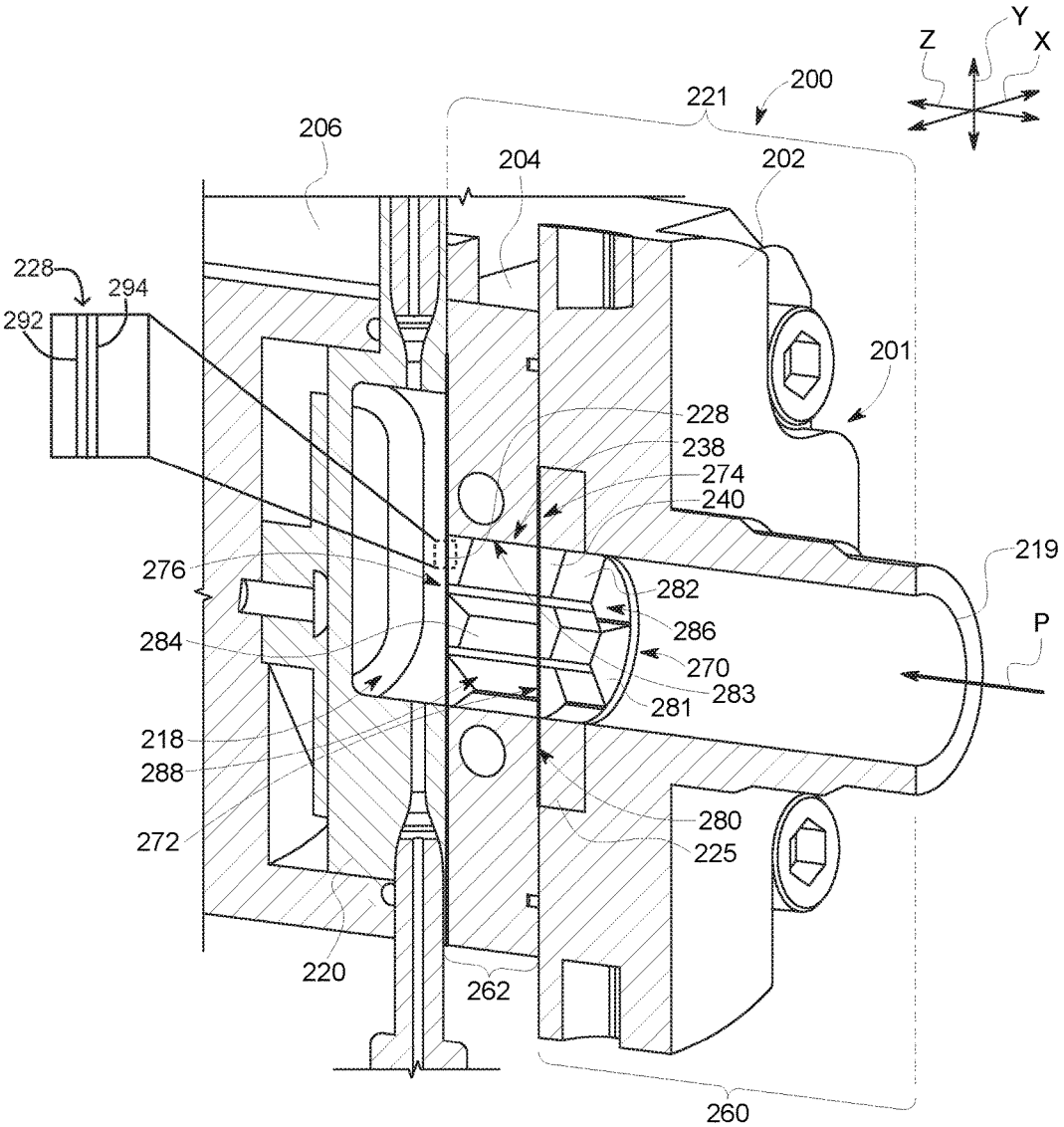
FIG. 7 is a sectional view of the target assembly of FIG. 3 taken transverse to an X axis.

Optionally, the target sheet 228 may include a layer that is not a graphene layer. For example, a chamber layer may be stacked with respect to the graphene layer. FIG. 7 illustrates one such target sheet 228. As shown, the target sheet 228 includes a graphene layer 294 and a chamber layer 292 stacked with respect to each other. As used herein, the chamber layer and the graphene layer are "stacked with respect to each other" if respective sides of the chamber layer and the graphene layer face each other and the sides (a) are essentially secured to each other in which, for example, the sides are bonded to each other or one layer is plated or coated to the other layer; (b) are discrete but directly engage each other (e.g., are pressed together); or (c) have one or more other layers positioned therebetween and are essentially secured to the one or more other layers or directly engage the one or more other layers. For example, each of the sides may directly engage or be bonded to opposite sides of a common layer. If multiple layers exists, the multiple layers may be sandwiched together. The graphene layer and the chamber layer engage or are bonded to opposite sides of the sandwich structure. In some embodiments, the graphene layer may engage other layers on either side of the graphene layer.

In particular embodiments, the chamber layer is configured to be exposed to the target material within the production chamber. The chamber layer may be devoid of a material that causes long-lived isotopes when activated by the particle beam and exposed to the target material. For instance, the chamber layer may be an inert metal material. The chamber layer may comprise, for example, gold, niobium, tantalum, titanium, or an alloy including one or more of the above. In particular embodiments, the chamber layer may consist essentially of gold, niobium, tantalum, or titanium.

It should be noted that the target and front sheets 228, 240 are not limited to a disc or circular shape and may be provided in different shapes, configurations and arrangements. For example, one or both of the target and front sheets 228, 240, or additional sheets, may be square shaped, rectangular shaped, or oval shaped, among others. Also, it should be noted that the target and front sheets 228, 240 are not limited to being formed from only graphene, but in various embodiments include an activating material, such as a moderately or high activating material that can have radioactivity induced therein as described in more detail herein. In some embodiments, the target and front sheets 228, 240 may include one or more metallic layers. The layers may include, for example, Havar. In some embodiments, the Havar may provide a backing that is not exposed to the target material and supports the graphene layer. Havar has a nominal composition of Co (42%), Cr (19.5%), Ni (12.7%), W (2.7%), Mo (2.2%), Mn (1.6%), C (0.2%), Fe balance.

During operation, as the particle beam passes through the target assembly 200 from the body section 202 into the production chamber 218, the target and front sheets 228, 240 may be heavily activated (e.g., radioactivity induced therein). The target and front sheets 228, 240 isolate a vacuum inside the accelerator chamber from the target material in the cavity 222. The grid section 238 may be disposed between and engage each of the target and front sheets 228, 240. Optionally, the target assembly 200 is not configured to permit a cooling medium to pass between the target and front sheets 228, 240. It should be noted that the target and front sheets 228, 240 are configured to have a thickness that allows a particle beam to pass therethrough. Consequently, the target and front sheets 228, 240 may become highly radiated and activated.

Some embodiments provide self-shielding of the target assembly 200 that actively shields the target assembly 200 to shield and/or prevent radiation from the activated target and front sheets 228, 240 from leaving the target assembly 200. Thus, the target and front sheets 228, 240 are encapsulated by an active radiation shield. Specifically, at least one of, and in some embodiments, all of the body sections 202, 204 and 206 are formed from a material that attenuates the radiation within the target assembly 200, and in particular, from the target and front sheets 228, 240. It should be noted that the body sections 202, 204 and 206 may be formed from the same materials, different materials or different quantities or combinations of the same or different materials. For example, body sections 202 and 204 may be formed from the same material, such as aluminum, and the body section 206 may be formed from a combination or aluminum and tungsten.

The body section 202, body section 204 and/or body section 206 are formed such that a thickness of each, particularly between the target and front sheets 228, 240 and the outside of the target assembly 200 provides shielding to reduce radiation emitted therefrom. It should be noted that the body section 202, body section 204 and/or body section 206 may be formed from any material having a density value greater than that of aluminum. Also, each of the body section 202, body section 204 and/or body section 206 may be formed from different materials or combinations or materials as described in more detail herein.

Figure 6:
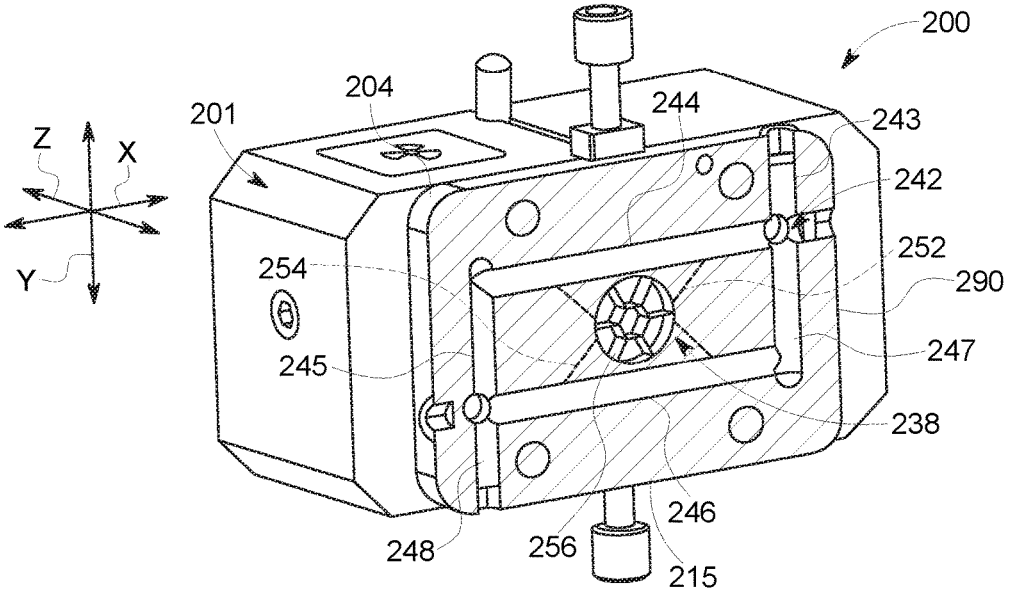
FIG. 6 is a sectional view of the target assembly taken transverse to a Z axis illustrating a cooling channel that absorbs thermal energy of the target assembly.

FIG. 6 is a sectional view of the target assembly 200. For reference, the target assembly 200 is oriented with respect to mutually perpendicular X, Y, and Z axes. The sectional view is made by a plane 290 that is oriented transverse to the Z axis and through the body section 204. In the illustrated embodiment, the body section 204 is an essentially uniform block of material that is shaped to include the grid section 238 and a cooling network 242. For example, the body section 204 may be molded or die-cast to include the physical features described herein. In other embodiments, the body section 204 may comprise two or more elements that are secured to each other. For example, the grid section 238 may be similarly shaped as the grid section 225 (FIG. 5) and be separate and discrete with respect to a remaining portion of the body section 204. In this alternative embodiment, the grid section 238 may be positioned within a void or cavity of the remaining portion.

As shown, the plane 290 through the body section 204 intersects the grid section 238 and the cooling network 242. The cooling network 242 includes cooling channels 243-248 that interconnect with one another to form the cooling network 242. The cooling network 242 also includes ports 249, 250 that are in flow communication with other channels (not shown) of the target body 201. The cooling network 242 is configured to receive a cooling medium (e.g., cooling water) that absorbs thermal energy from the target body 201 and transfers the thermal energy away from the target body 201. For example, the cooling network 242 may be configured to absorb thermal energy from at least one of the grid section 238 or the target chamber 218 (FIG. 5). As shown, the cooling channels 244, 246 extend proximate to the grid section 238 such that respective thermal paths 252, 254 (generally indicated by dashed lines) are formed between the grid section 238 and the cooling channels 244, 246. For example, gaps between the grid section 238 and the cooling channels 244, 246 may be less than 10 mm, less than 8 mm, less than 6 mm, or, in certain embodiments, less than 4 mm. Thermal paths may be identified using, for example, modeling software or thermal imaging during experimental setups.

The grid section 238 includes an arrangement of interior walls 256 that coupled to one another to form a grid or frame structure. The interior walls 256 may be configured to (a) provide sufficient support for the target and front sheets 228, 240 (FIG. 5) and (b) intimately engage the target and front sheets 228, 240 so that thermal energy may be transferred from the target and front sheets 228, 240 to the interior walls 256 and a peripheral region of the grid section 238 or the body section 204.

Figure 8:
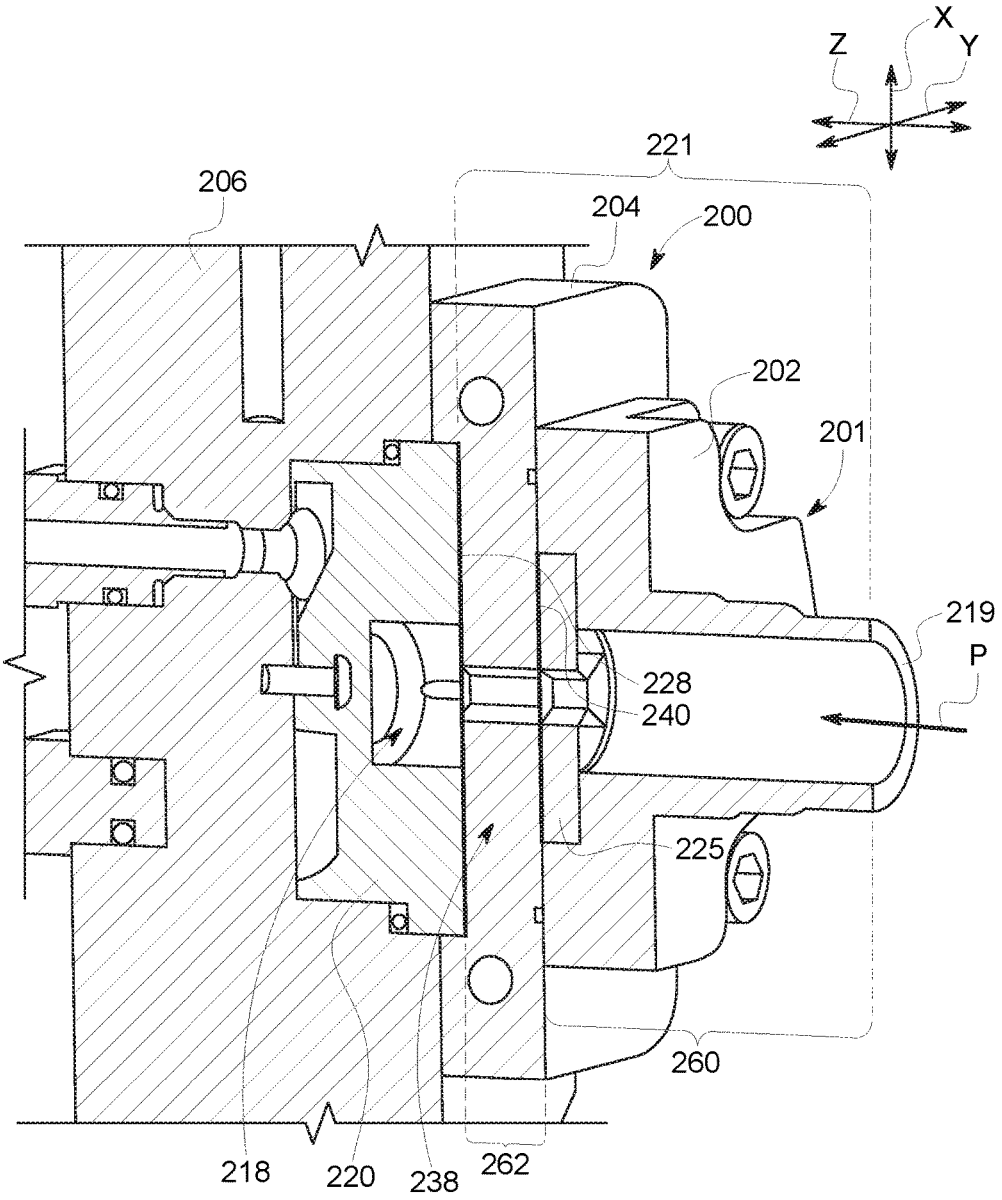
FIG. 8 is a sectional view of the target assembly of FIG. 3 taken transverse to a Y axis.

FIGS. 7 and 8 are sectional views of the target assembly 200 taken transverse to the X and Y axes, respectively. As shown the target assembly 200 is in an operable state in which the body sections 202, 204, 206, the target insert 220, and the grid section 225 are stacked with respect to one another along the Z axis and secured to one another. It should be understood that the target body 201 shown in the figures is one particular example of how a target body may be configured and assembled. Other target body designs that include the operable features (e.g., grid section(s)) are contemplated.

The target body 201 includes a series of cavities or voids through which the particle beam P extends through. For example, the target body 201 includes the production chamber 218 and the beam passage 221. The production chamber 218 is configured to hold a target material (not shown) during operation. The target material may flow into and out of the production chamber 218 through, for example, the first material port 214. The production chamber 218 is positioned to receive the particle beam P that is directed through the beam passage 221. The particle beam P is received from a particle accelerator (not shown), such as the particle accelerator 102 (FIG. 1), which is a cyclotron in the exemplary embodiment.

The beam passage 221 includes a first passage segment (or front passage segment) 260 that extends from the passage opening 219 to the front sheet 240. The beam passage 221 also includes a second passage segment (or rear passage segment) 262 that extends between the front sheet 240 and the target sheet 228. For illustrative purposes, the front sheet 240 and the target sheet 228 have been thickened for easier identification. The grid section 225 is positioned at an end of the first passage segment 260. The grid section 238 defines an entirety of the second passage segment 262. In the illustrated embodiment, the grid section 238 is an integral part of the body section 204 and the grid section 225 is a separate and discrete element that is sandwiched between the body section 202 and the body section 204.

Accordingly, the grid sections 225, 238 of the target body 201 are disposed in the beam passage 221. As shown in FIG. 7, the grid section 225 has a front side 270 and a back side 272. The grid section 238 also has a front side 274 and a back side 276. The back side 272 of the grid section 225 and the front side 274 of the grid section 238 abut each other with an interface 280 therebetween. The back side 276 of the grid section 238 faces the production chamber 218. In the illustrated embodiment, the back side 276 of the grid section 238 engages the target sheet 228. The front sheet 240 is positioned between the grid sections 225, 238 at the interface 280.

Also shown in FIG. 7, the grid section 225 has a radial surface 281 that surrounds the beam passage 221 and defines a profile of a portion of the beam passage 221. The profile extends parallel to a plane defined by the X and Y axes. The grid section 238 has a radial surface 283 that surrounds the beam passage 221 and defines a profile of a portion of the beam passage 221. The profile extends parallel to a plane defined by the X and Y axes. In the illustrated embodiment, the radial surface 283 is devoid of ports that are fluidically coupled to channels of the target body. More specifically, the second passage segment 262 may not have forced fluid pumped therethrough for cooling the target and front sheets 228, 240 in some embodiments. In alternative embodiments, however, a cooling medium may be pumped therethrough. Yet in other embodiments, ports may be used to evacuate the second passage segment 262.

The grid sections 225, 238 have respective interior walls 282, 284 that define grid channels 286, 288 therethrough. The interior walls 282, 284 of the grid sections 225, 238, respectively, engage opposite sides of the front sheet 240. The interior walls 284 of the grid section 238 engage the target sheet 228 and the front sheet 240. The interior walls 282 of the grid section 225 only engage the front sheet 240. The front and target sheets 240, 228 are oriented transverse to a beam path of the particle beam P. The particle beam P is configured to pass through the grid channels 286, 288 toward the production chamber 218.

In some embodiments, the grid structure formed by the interior walls 282 and the grid structure formed by the interior walls 284 are identical such that the grid channels 286, 288 align with one another. However, embodiments are not required to have identical grid structures. For example, the grid section 225 may not include one or more of the interior walls 282 and/or one or more of the interior walls 282 may not be aligned with corresponding interior walls 284 or vice versa. Moreover, it is contemplated that the interior walls 282 and the interior walls 284 may have different dimensions in other embodiments.

Optionally, the front sheet 240 is configured to substantially reduce the energy level of the particle beam P when the particle beam P is incident on the front sheet 240. More specifically, the particle beam P may have a first energy level in the first passage segment 260 and a second energy level in the second passage segment 262 in which the second energy level is substantially less than the first energy level. For example, the second energy level may be more than 5% less than the first energy level (or 95% or less of the first energy level). In certain embodiments, the second energy level may be more than 10% less than the first energy level (or 90% or less of the first energy level). Yet in more particular embodiments, the second energy level may be more than 15% less than the first energy level (or 85% or less of the first energy level). Yet in more particular embodiments, the second energy level may be more than 20% less than the first energy level (or 80% or less of the first energy level). By way of example, the first energy level may be about 18 MeV, and the second energy level may be about 14 MeV. It should be understood, however, that the first energy level may have different values in other embodiments and the second energy level may have different values in other embodiments.

In such embodiments in which the front sheet 240 substantially reduces the energy level of the particle beam P, the front sheet 240 may be characterized as a degrader sheet. The degrader sheet 240 may have a thickness and/or composition that creates substantial losses as the particle beam P passes through the front sheet 240. For example, the front sheet 240 and the target sheet 228 may have different compositions and/or thicknesses. The front sheet 240 may comprise aluminum, and the target sheet 228 may comprise graphene as described herein. Alternatively, the front sheet 240 may also comprise a graphene layer.

In particular embodiments, the front sheet 240 and the target sheet 228 have different thicknesses. For example, a thickness of the front sheet 240 may be at least 0.10 millimeters (mm) (or 100 micrometers). In particular embodiments, the front sheet 240 has a thickness that is between 0.15 mm and 0.50 mm.

In some embodiments, the target sheet 228 is at least five times (5×) thicker than the stripper sheet 160 or is at least eight times (8×) thicker than the stripper sheet 160. In particular embodiments, the target sheet 228 is at least ten times (10×) thicker than the stripper sheet 160, at least fifteen times (15×) thicker than the stripper sheet 160, or at least twenty times (20×) thicker than the stripper sheet 160.

Although the front sheet 240 may be characterized as a degrader sheet in some embodiments, the front sheet 240 may not be a degrader sheet in other embodiments. For instance, the front sheet 240 may not substantially reduce or only nominally reduce the energy level of the particle beam P. In such instances, the front sheet 240 may have characteristics (e.g., thickness and/or composition) that are similar to characteristics of the target sheet 228.

The losses in the front sheet 240 correspond to thermal energy that is generated within the front sheet 240. The thermal energy generated within the front sheet 240 may be absorbed by the body section 204, including the grid section 238, and conveyed to the cooling network 242 where the thermal energy is transferred from the target body 201.

Although some thermal energy may be generated within the target sheet 228 when the particle beam is incident thereon, a majority of the thermal energy from the target sheet 228 may be generated within the production chamber 218 when the particle beam P is incident on the target material. The production chamber 218 is defined by an interior surface 266 of the target insert 220 and the target sheet 228. As the particle beam P collides with the target material, thermal energy is generated. This thermal energy may be conveyed or transferred through the target sheet 228, into the body section 204, and absorbed by the cooling medium flowing through the cooling network 242.

During operation of the target assembly 200, the different cavities may experience different pressures. For example, as the particle beam P is incident upon the target material, the first passage segment 260 may have a first operating pressure, the second passage segment may 262 may have a second operating pressure, and the production chamber 218 may have a third operating pressure. The first passage segment 262 is in flow communication with the particle accelerator, which may be evacuated. Due to the thermal energy and bubbles generated within the production chamber 218, the third operating pressure may be significantly large. For example, the pressure may be between 0.50 and 15.00 megapascals (MPa) or, more specifically, between 0.50 and 11.00 MPa. Moreover, the pressure may rise and fall rapidly such that the target sheet 228 experiences bursts of high pressure depending upon the target material.

In the illustrated embodiment, the second operating pressure may be a function of the operating temperature of the grid section 238. Thus, the first operating pressure may be less than the second operating pressure and the second operating pressure may be less than the third operating pressure.

The grid sections 225, 238 are configured to intimately engage opposite sides of the front sheet 240. In addition, the interior walls 282 may prevent the pressure differential between the second passage segment 262 and the first passage segment 260 from moving the front sheet 240 away from the interior walls 284. The interior walls 284 may prevent the pressure differential between the production chamber 218 and the second passage segment 262 from moving the target sheet 228 into the second passage segment 262. The larger pressure in the production chamber 218 forces the target sheet 228 against the interior walls 284. Accordingly, the interior walls 284 may intimately engage the front sheet 240 and the target sheet 228 and absorb thermal energy therefrom. Also show in FIGS. 7 and 8, the surrounding body section 204 may also intimately engage the front sheet 240 and the target sheet 228 and absorb thermal energy therefrom.

In particular embodiments, the target assembly 200 is configured to generate isotopes that are disposed within a liquid that may be harmful to the particle accelerator. For example, the starting material for generating $^{68}$Ga isotopes may include a highly acidic solution. To impede the flow of this solution, the front sheet 240 may entirely cover the beam passage 221 such that the first passage segment 260 and the second passage segment 262 are not in flow communication. In this manner, unwanted acidic material may not inadvertently flow from the production chamber 218, through the second and first passage segments 262, 260, and into the particle accelerator. To decrease this likelihood, the front sheet 240 may be more resistant to rupture. For instance, the front sheet 240 may comprise a material having a greater structural integrity (e.g., aluminum) and a thickness that reduces the likelihood of rupture.

In other embodiments, the target assembly 200 is devoid of the target sheet 228, but includes the front sheet 240. In such embodiments, the grid section 238 may form a part of the production chamber. For example, the target material may be a gas and be located within a production chamber that is defined between the front sheet 240 and cavity 222. The grid section 238 may be disposed in the production chamber. In such embodiments, only a single sheet (e.g., the front sheet 240) is used during production and the single sheet is held between the two grid sections 225, 238.

Figure 9:
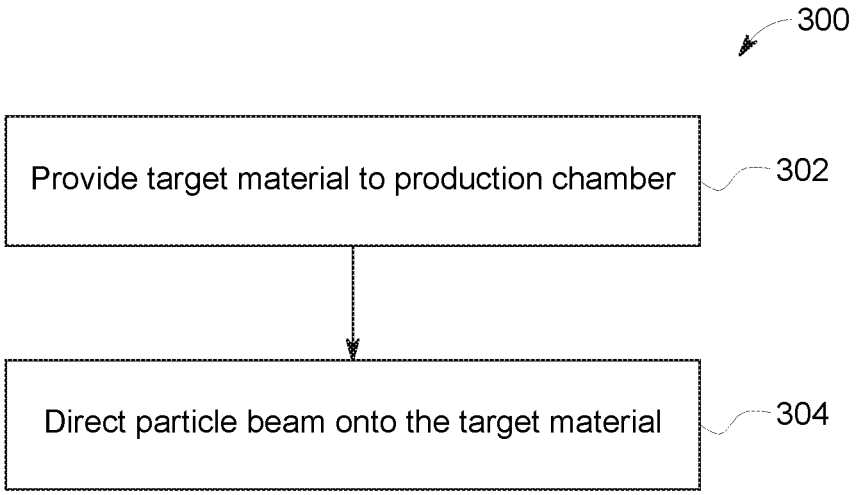
FIG. 9 is a flowchart illustrating a method in accordance with an embodiment.

FIG. 9 illustrates a method 300 of generating radioisotopes. The method 300, for example, may employ structures or aspects of various embodiments (e.g., isotope production systems, target systems, and/or methods) described herein. The method includes providing, at 302, a target material into a production chamber of a target body or target assembly, such as the target body 201 or the target assembly 200. In some embodiments, the target material is an acidic solution. In particular embodiments, the method 300 is configured to generate $^{68}$Ga through a $^{68}$Zn(p,n)$^{68}$Ga reaction in aqueous solution. More specifically, the method 300 is configured to generate $^{68}$Ga isotopes from $^{68}$Zn nitrate in nitric acid.

It should be understood, however, that embodiments are not required to generate $^{68}$Ga isotopes. A variety of target materials may be used for generating other isotopes. By way of example, a radioisotope production system may generate protons to make $^{18}F^-$ isotopes in liquid form, $^{11}$C isotopes as $CO_2$, and $^{13}$N isotopes as $NH_3$. The target material used to make these isotopes may be enriched $^{18}$O water, natural $^{14}N_2$ gas, $^{16}$O-water. The radioisotope production system may also generate protons or deuterons in order to produce $^{15}$O gases (oxygen, carbon dioxide, and carbon monoxide) and $^{15}$O labeled water.

In particular embodiments, the target material may be natural $^{14}N_2$ gas and the target sheet may comprise a chamber layer that separates the graphene from the production chamber. For example, the chamber layer may comprise gold, niobium, tantalum, titanium, an alloy including one or more of the above, or another inert material for the intended application. The chamber layer may impede the flow of non-active carbon from the graphene layer to the production chamber.

The target body has a beam passage that receives the particle beam and permits the particle beam to be incident upon the target material. The target body also includes a grid section, such as the grid section 238, disposed in the beam passage. The grid section 238 is configured to support a target sheet comprising a graphene layer. The target sheet is exposed to the target material (e.g., liquid). Optionally, an additional grid section, such as the grid section 225, is disposed in the beam passage. A front sheet (e.g., degrader foil) may be positioned between the two grid sections. Each of the first and second grid sections has front and back sides. The back side of the first grid section and the front side of the second grid section abut each other with an interface therebetween. The back side of the second grid section faces the production chamber.

In alternative embodiments, the target body does not include any grid section for supporting the target sheet. In such embodiments, the pressure generated with the production chamber may be sufficiently low such that the target sheet may withstand the pressure during isotope production. Alternatively or in addition to the above, the graphene layer may have a designated thickness and/or tensile strength such that the target sheet may withstand the pressure during isotope production. Alternatively or in addition to the above, an additional layer may be positioned to support the graphene layer. For example, a layer of Havar may be positioned behind the target sheet such that the target sheet is positioned between the production chamber and the layer of Havar during isotope production.

The method also includes directing, at 304, the particle beam onto the target material. In some embodiments, the isotope production system 100 uses technology and brings the charged particles to a designated energy with a designated beam current of approximately 10-30 μA. The particle beam passes through the optional front sheet (e.g., degrader sheet or foil) and through the target sheet into the production chamber. In some embodiments, the front sheet may reduce the energy of the particle beam by at least 10%. The energy of the particle beam that is incident upon the target material may be less than 24 MeV, less than 18 MeV, or less 8 MeV. The energy of the particle beam that is incident upon the target material may be between 7 MeV and 24 MeV. In particular embodiments, the energy of the particle beam that is incident upon the target material may be between 12 MeV and 18 MeV. In more particular embodiments, the energy of the particle beam that is incident upon the target material may be about 13 MeV to about 15 MeV. However, it should be understood that the energy of the particle beam may be greater than or less than the values described above. For example, the energy of the particle beam may be more than 24 MeV in some embodiments.

Target sheets comprising a graphene layer may cause lower temperatures in the target sheet during isotope production compared to conventional foils (e.g., aluminum, Havar) for the same isotope production process. As such, the target sheet may enhance the capabilities of the target system by allowing isotope production processes that desire lower temperatures and were previously incapable of being performed by the target system. Moreover, target sheets comprising a graphene layer may absorb less energy from the particle beam compared to conventional foils for the same isotope production process. In addition, the target sheets comprising a graphene layer may become less activated over time compared to conventional foils for the same isotope production process. The target sheets comprising a graphene layer may contaminate the target media less compared to conventional foils for the same isotope production process.

Embodiments described herein are not intended to be limited to generating radioisotopes for medical uses, but may also generate other isotopes and use other target materials. Also the various embodiments may be implemented in connection with different kinds of cyclotrons having different orientations (e.g., vertically or horizontally oriented), as well as different accelerators, such as linear accelerators or laser induced accelerators instead of spiral accelerators. Furthermore, embodiments described herein include methods of manufacturing the isotope production systems, target systems, and cyclotrons as described above.

Embodiments described herein are not intended to be limited to generating radioisotopes for medical uses, but may also generate other isotopes and use other target materials. Also the various embodiments may be implemented in connection with different kinds of cyclotrons having different orientations (e.g., vertically or horizontally oriented), as well as different accelerators, such as linear accelerators or laser induced accelerators instead of spiral accelerators. Furthermore, embodiments described herein include methods of manufacturing the isotope production systems, target systems, and cyclotrons as described above.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f) unless and until such claim limitations expressly use the phrase "means for" followed by a statement of function void of further structure.

This written description uses examples to disclose the various embodiments, and also to enable a person having ordinary skill in the art to practice the various embodiments, including making and using any devices or systems and performing any incorporated methods. The patentable scope of the various embodiments is defined by the claims, and may include other examples that occur to those skilled in the art. Such other examples are intended to be within the scope of the claims if the examples have structural elements that do not differ from the literal language of the claims, or the examples include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, or the like). Similarly, the programs may be stand-alone programs, may be incorporated as subroutines in an operating system, may be functions in an installed software package, or the like. The various embodiments are not limited to the arrangements and instrumentality shown in the drawings.

What is claimed is:

1. An isotope production system comprising:

a particle accelerator configured to generate a particle beam, the particle accelerator including a stripper foil; and a target assembly including a target body having a production chamber and a beam cavity that is adjacent to the production chamber, the production chamber including a target material, the beam cavity opening to an exterior of the target body and being configured to receive a particle beam that is incident on the production chamber, the target assembly also including a target sheet positioned to separate the beam cavity and the production chamber, the target sheet having a side that is exposed to the production chamber, the target material is positioned in the target body and is in contact with the target sheet during isotope production, wherein the target sheet comprises graphene, and wherein the target sheet is at least 15 times thicker than the stripper foil.

2. The isotope production system of claim 1, wherein the target sheet includes a graphene layer that consists essentially of graphene.

3. The isotope production system of claim 1, wherein the target sheet also includes a chamber layer that is stacked with respect to the graphene layer, the chamber layer being positioned between the graphene layer and the production chamber and exposed to the production chamber, the target material is positioned in the target body and is in contact with the chamber layer during isotope production.

4. The isotope production system of claim 3, wherein the chamber layer is comprised of an inert metal material.

5. The isotope production system of claim 3, wherein the target sheet has a thickness that is at least 20 micrometers.

6. The isotope production system of claim 3, wherein the target body includes a grid section disposed in the beam passage, the grid section having a back side that interfaces with a front side of the target sheet, the grid section supporting the target sheet to reduce the likelihood of rupture from elevated pressure in the production chamber.

7. The isotope production system of claim 1, further comprising a fluid-control system configured to flow $^{68}Zn$ nitrate in nitric acid into the production chamber.

* * * * *